United States Patent [19]

Chu et al.

[11] 4,148,692

[45] Apr. 10, 1979

[54] PROCESS FOR PRODUCING LOW REACTIVITY CALCINED COKE AGGLOMERATES

[75] Inventors: Vincent H. K. Chu; Louis G. Benedict; Sidney V. Fox, all of Bethlehem, Pa.

[73] Assignee: Bethlehem Steel Corporation, Bethlehem, Pa.

[21] Appl. No.: 828,055

[22] Filed: Aug. 26, 1977

[51] Int. Cl.[2] ..... C10B 57/12

[52] U.S. Cl. ..... 201/36; 201/6; 201/21; 201/20; 201/22; 201/34; 201/37; 201/44

[58] Field of Search ..... 201/6, 20, 21, 22, 34, 201/36, 37, 44

[56] References Cited

U.S. PATENT DOCUMENTS

| | | | |
|---|---|---|---|
| 3,140,241 | 7/1964 | Work et al. | 201/36 X |
| 3,184,293 | 5/1965 | Work et al. | 201/6 X |
| 3,185,635 | 5/1965 | Creglow | 201/36 X |
| 3,368,012 | 2/1968 | Erickson | 264/117 |
| 3,401,089 | 9/1968 | Friedrich et al. | 201/6 |
| 3,444,046 | 5/1969 | Harlow | 201/6 |

*Primary Examiner*—Barry S. Richman

*Attorney, Agent, or Firm*—Joseph J. O'Keefe; Charles A. Wilkinson; John S. Simitz

[57] ABSTRACT

A process for producing calcined coke agglomerates characterized by having a low reactivity to carbon dioxide. The process includes calcining green coal agglomerates at a temperature within the range of 1700° F. to 1950° F. (927° C. to 1066° C.) in a calciner. The agglomerates are exposed to a gaseous atmosphere which before cracking contains not less than 20% by volume of at least one straight chain aliphatic hydrocarbon gas containing one to four carbon atoms. The gaseous atmosphere is preheated to a temperature within the range of 200° F. to 700° F.(93° C. to 371° C.) prior to being introduced into the calciner. Carbon produced when the hydrocarbon gas is cracked, is deposited as vitreous carbon on the surfaces, in the fissures and in the pores of the agglomerates. The calcined coke aggglomerates discharged from the calciner have a reactivity to carbon dioxide of between 2% to 8%.

8 Claims, 5 Drawing Figures

REACTIVITY OF CALCINED COKE AGGLOMERATES AT 1700F (927C)
% REACTIVITY OF CALCINED AGGLOMERATES TO $CO_2$ GAS
% HYDROCARBON GAS —— (REMAINDER INERT NITROGEN) ——
e (100 % $N_2$ ATMOSPHERE)
a (METHANE)
b (ETHANE)
c (PROPANE)
BUTANE
h BUTANE
0
1
2
3
4
5
6
7
8
9
10
11
12
13
14
15
0
10
20
30
40
50
60
70
80
90
100

GREEN COAL AGGLOMERATES

RECYCLE TO PLANT
33⅓% OF OFF-GAS
VOLUME
B
66⅔% OF OFF-GAS
VOLUME
A
OFF GASES
900 F (482 C)
C
CALCINER
WATER COOLING
OF GAS TO 86 F (30C)
AIR
ZONE 1
COMBUSTION OF
AIR & GASES
2200 F (1204C)
C'
D'
I
H
1700 F (927C)
1750 F
(954C)
D
ZONE 2
HEATED GAS
E
F
COOLING GAS
86 F (30 C)
ZONE 3
G
K
K
L

PROCESS FOR PRODUCING LOW REACTIVITY CALCINED COKE AGGLOMERATES

BACKGROUND OF THE INVENTION

Metallurgical coke, used both as a fuel and as a reducing agent in the production of iron, is made in slot ovens by destructive distillation of selected bituminous coals which meet restrictive specifications. The coals or blend of coals are heated to a temperature of about 2350° F. (1288° C.) to produce lumps of coke which generally have a reactivity to carbon dioxide gas of about 2% to 8% as measured by a modified test described in an article in the publication of the AISI Technical Meeting, 1970 by R. R. Thompson et al entitled, "Improvement of Coke Uniformity through Measurement of Coke Reactivity".

Deposits of high grade coals, which meet the restrictive specifications required for producing metallurgical coke, are being depleted. Vast deposits of coals which do not meet the restrictive specifications for metallurgical coking coals and hence are not considered suitable for producing metallurgical coke in slot ovens are known. There have been concentrated efforts to produce a metallurgical coke substitute from these vast deposits of inferior coals. The coke substitute produced from these coals is generally referred to as formed coke. Formed coke is defined as uniform calcined agglomerates made from coals which do not meet the restrictive specifications of metallurgical coking coals. The agglomerates can be formed by extrusion, briquetting or balling. The agglomerates so formed are calcined at a temperature within the range of about 1700° F. to 1950° F. (927° C. to 1066° C.). Such agglomerates have a relatively high reactivity, generally about 16%, to carbon dioxide. Because of the high reactivity of these agglomerates some of the carbon which they contain is consumed in solution-loss reactions in the upper portion of the blast furnace, thus the full use of the reducing action of the carbon is not realized during the reduction of iron oxide to iron.

It is the object of this invention to provide a process for producing calcined agglomerates such as calcined coke agglomerates, made from bituminous coals and blends of coals, such calcined agglomerates being characterized by having a reactivity to carbon dioxide gas comparable to slot-oven lump coke.

SUMMARY OF THE INVENTION

Green coal agglomerates are calcined in a calciner at a temperature within the range of 1700° F. to 1950° F. (927° C. to 1066° C.). While the agglomerates are at the calcining temperature a quantity of a gas containing at least 20% of one straight chain aliphatic hydrocarbon gas selected from the group consisting of methane, ethane, propane and butane is preheated to a temperature within the range of 200° F. to 700° F. (93° C. to 371° C.) and is introduced into the calciner. The hydrocarbon gas is cracked at the temperature in the calciner forming carbon and hydrogen. The carbon is deposited as vitreous carbon on the surfaces, in the fissures and in the pores of the agglomerates. The spent hydrocarbon gases are removed from the calciner. The calcined coke agglomerates coated with vitreous carbon are cooled to 300° F. (149° C.) and are discharged from the calciner. The calcined coke agglomerates have a reactivity to carbon dioxide of 2% to 8%.

FIGURES OF THE INVENTION

FIG. 1A is a graph comparing the reactivity of calcined coke pellets which have been calcined at a temperature of 1700° F. (927° C.) in the presence of cracked straight-chain hydrocarbon gases. Curves a, b and c are the results found when using methane-nitrogen, ethane-nitrogen and propane-nitrogen respectively.

The graph of FIG. 1B shows the results of tests using atmospheres which contained 100% methane or propane at various temperatures.

PREFERRED EMBODIMENT OF THE INVENTION

Figure 1A:
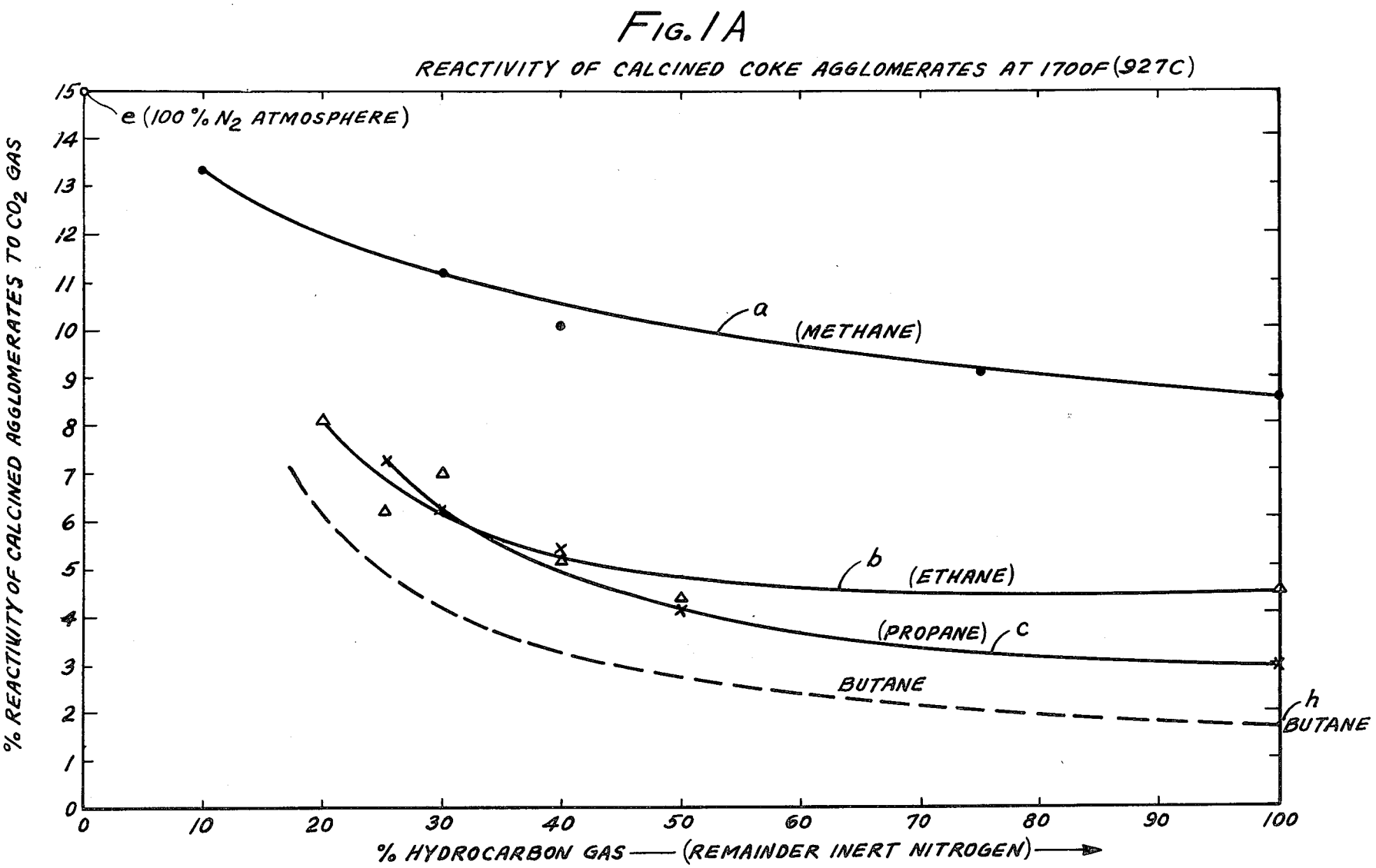

Green coal agglomerates made from coals or blends of coals and optionally a binder are charged at a temperature within the range of 750° F. to 850° F. (399° C. to 454° C.) into a calciner. The green coal agglomerates are heated to a temperature within the range of 1700° to 1850° F. (927° C. to 1010° C.) preferably by heat exchange with heated gases in the calciner, although other methods of heating may also be used. The green coal agglomerates are calcined to form calcined coke agglomerates. By a green coal agglomerate we mean an agglomerate generally spherical in shape formed by heating a mixture of coal fines and char and optionally tar in a rotating agglomerating drum to a temperature within the range of about 750° F. to 900° F. (399° C. to 482° C.) whereby about 90% of the volatile matter in the mixture is driven off and about 10% is retained in the agglomerate.

A gaseous atmosphere containing a portion of at least one straight chain aliphatic hydrocarbon gas containing one to four carbon atoms, preheated to a temperature between 200° F. and 700° F. (93° C. to 371° C.) is introduced into the calciner at a linear velocity of between about 40 to 65 centimeters per minute when measured at a temperature of not more than 200° F. (93° C.). The hyrocarbon gas is cracked at the temperatures existing in the calciner to form carbon and hydrogen. The carbon is deposited on the surfaces, in the fissures and in the pores of the agglomerates in the form of vitreous carbon. The calcined coke agglomerates are cooled to about 300° F. (149° C.) and are discharged from the calciner. The calcined coke agglomerates coated with vitreous carbon are characterized by having a reactivity to carbon dioxide of about 2% to 8%, which reactivity compares favorably with the reactivity of metallurgical coke produced in slot-oven furnaces.

When the green coal agglomerates are heated by contact with hot gases within the calciner as the green coal agglomerates pass downwardly through the calciner, as in a commercial calcining apparatus, it is desirable to inject the hydrocarbon gas into the calciner below the level at which the heating gas enters the calciner so that the hot heat exchange gases do not interfere with the deposition of the vitreous carbon on the surface of the agglomerates. The agglomerates will in this case first be heated to the calcining temperature and, while still at an elevated temperature, be contacted with the hydrocarbon gas to deposit the vitreous carbon. Of course, if other arrangements for heating and calcining the green coal agglomerates are used, the arrangement for contacting the agglomerates with the hydrocarbon gas may also be different. The essential element of the process is that the heated agglomerates be contacted with a hydrocarbon gas in a manner such that the gas is cracked in the presence of the agglomerates and vitreous carbon is deposited upon the agglomerates.

It has been found that the reactivity of the calcined coke agglomerates produced as described above is inversely related to the amount of the straight chain aliphatic hydrocarbon gas or gases introduced into the atmosphere of the calciner, the carbon chain length of the hydocarbon gas and by the temperature of calcining.

Figure 1B:
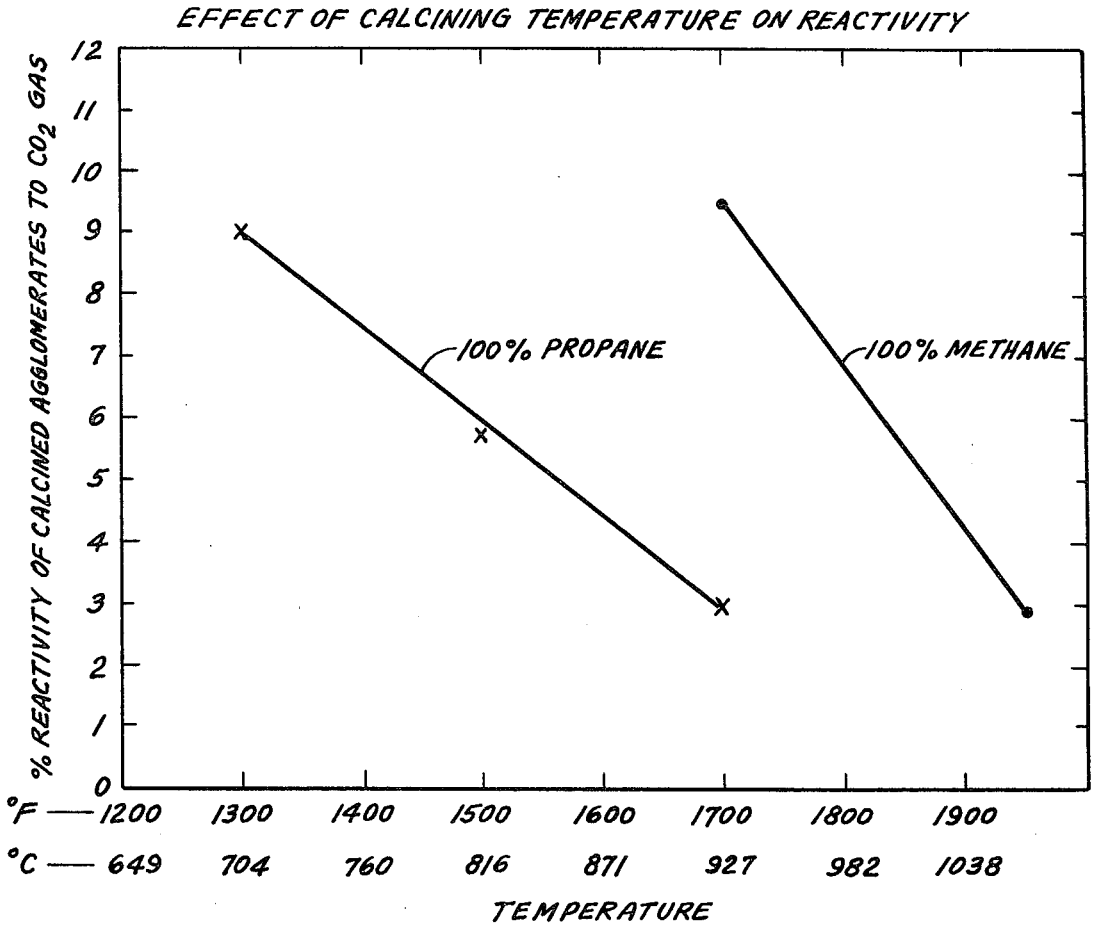

In examples of the invention, green spherical-like agglomerates or green coal pellets having a diameter within the range of ¾ of an inch to three inches, were made from a mix of 38% by weight of a West Virginia high-volatile coal, 56% by weight char and 6% by weight topped tar by a well known process as described in U.S. Pat. No. 3,368,012, entitled "Process for Agglomerating Carbonaceous Materials" issued to Arnold R. Erickson. The green coal aggolmerates were divided into several equal lots. Typically, the West Virginia coal has the following chemical analysis on a weight basis; Vol matter 36.9%, Ash (dry basis) 6.4%, Sulfur 0.9%, Moisture 1.91%, F.C. 54.8%. Some of the lots were placed in a horizontal tube furnace heated by an electrical resistance winding to the calcining temperature of 1700° F. (927° C.). The pellets were held at temperature for 120 minutes. Other lots were tested at other temperatures. A continuous flow of an atmosphere containing at least one straight chain aliphatic hydrocarbon gas was fed through the tube during the heating and cooling cycles. The results of tests with various concentrations of several aliphatic straight chain hydocarbon gases are shown in the graphs, FIGS. 1A and 1B. FIG. 1A shows how the type and concentration of the hydrocarbon gas affect reactivity when the gas is used to treat the agglomerates at 1700° F. (927° C.), which is a preferred temperature for calcining green coal agglomerates. FIG. 1B shows the effect of varying the treatment temperature when the agglomerates are treated with propane and methane, respectively.

Curves a, b and c in FIG. 1A are graphic representations of the reactivity of the calcined coke agglomerates which had been calcined in atmospheres containing specific amounts of methane ($CH_4$), ethane ($C_2H_6$) and propane ($C_3H_8$) respectively. In these specifications and claims all gas compositions are by volume unless otherwise noted. As the volume of the hydrocarbon gas introduced into the atmosphere of the calciner increased, the reactivity of the calcined coke agglomerates decreased. As the length of the carbon chain of the hydrocarbon gas increased, the reactivity of the calcined coke agglomerates decreased. Calcined coke agglomerates which had been calcined in a gaseous atmosphere containing methane ($CH_4$) generally had a higher reactivity to carbon dioxide than the range specified for slot oven lump coke, that is, above 8%. As noted previously, another way of lowering the reactivity is to raise the calcining temperature. As shown in FIG. 1B, calcined coke agglomerates which had been calcined at a temperature of 1950° F. (1066° C.) in an atmosphere of 100% methane ($CH_4$) having a linear velocity of about 40 centimeters per minute had a reactivity of 2.8% which is well below the maximum of 8% of slot oven lump coke whereas calcined coke agglomerates treated at 1700° F. (927° C.) had a reactivity of 8.4%.

As can be seen in FIG. 1A, the reactivity of the calcined coke agglomerates which had been calcined in an atmosphere containing 30% ethane ($C_2H_6$) and 70% nitrogen ($N_2$) and introduced into the calciner at a linear velocity of 50 centimeters per minute, or in an atmosphere containing 30% propane ($C_3H_8$) and 70% nitrogen ($N_2$) introduced into the calciner at a linear velocity of 50 centimeters per minute, had 7.0% and 6.2% reactivity to carbon dioxide gas, respectively. The calcined coke agglomerates which had been calcined in an atmosphere containing 30% methane ($CH_4$) and 70% nitrogen and introduced into the calciner at a linear velocity of 40 centimeters per minute had a reactivity of 11.2%. Comparing the reactivities of calcined coke agglomerates which had been calcined in atmospheres which contained 100% methane ($CH_4$), 100% ethane ($C_2H_6$), and 100% propane ($C_3H_8$) also indicated that both ethane ($C_2H_6$) and propane ($C_3H_8$) are more effective in decreasing the reactivity of the calcined coke agglomerates than is methane ($CH_4$). It is preferred to use at least 20% propane ($C_3H_8$) in the calcining atmosphere. While methane ($CH_4$) does not have as much effect on the reactivity of calcined coke agglomerates as do ethane ($C_2H_6$) and propane ($C_3H_8$), methane does lower the reactivity of calcined coke agglomerates and can also be used in the process of the invention. Calcined coke agglomerates which had been calcined in an atmosphere containing 30% methane ($CH_4$) and 70% nitrogen ($N_2$) had a reactivity of 11.2% whereas calcined coke agglomerates which had been calcined in an atmosphere containing 100% nitrogen, identified at e of FIG. 1A, had a reactivity of 15%. Calcined coke agglomerates which had been calcined in an atmosphere containing more than 20% ethane ($C_2H_6$) or propane ($C_3H_8$) had reactivities below the maximum desired reactivity of 8.0% indicative of slot-oven coke, as shown by curves b and c.

One lot of the green coal agglomerates was calcined at 1950° F. (1066° C.) in an atmosphere containing 100% methane ($CH_4$) which was introduced into the calciner at a linear velocity of 50 centimeters per minute. The reactivity of the calcined coke agglomerates was found to be 2.8% as noted previously. Other lots of calcined coke agglomerates which had been calcined at temperatures of 1300° F. (704° C.) and 1500° F. (816° C.) respectively in an atmosphere containing 100% propane which was introduced into the calciner at a linear velocity of 40 centimeters per minute had reactivities of 8.9% and 5.7%, respectively, as shown in FIG. 1B. It can be seen that the reactivity of calcined coke agglomerates is inversely related to the calcining temperature.

Another lot of the green coal agglomerates was calcined at 1700° F. (927° C.) in an atmosphere containing 100% butane ($C_4H_{10}$) which was introduced into the calciner at a linear velocity of 50 centimeters per minute. The reactivity of the calcined coke agglomerates was 1.7%, identified at point h of FIG. 1A. While only one point for butane ($C_4H_{10}$) has been identified, it is believed that the curve for indicating the effect of calcining green coal agglomerates in the presence of butane ($C_4H_{10}$) will generally be similar to the effect of calcining green coal agglomerates in the previously mentioned hydrocarbon gases and shown in the curves, a, b and c on FIG. 1A. Since the curve for butane ($C_4H_{10}$) is speculative, however, the curve is shown as a dotted line.

It is preferred to produce calcined coke agglomerates by calcining green coal agglomerates at a temperature of about 1700° F. (927° C.) in the presence of an atmosphere which contains at least 20% propane ($C_3H_8$) when introduced into the calciner at a liner velocity of about 40 centimeters per minute measured at a temperature of not more than 200° F. (93° C.). It is of course within the scope of this invention to calcine green coal agglomerates within a temperature range of about 1700° F. (927° C.) to 1950° F. (1066° C.) in an atmosphere which when introduced into the calciner contains at least 20% methane ($CH_4$), or ethane ($C_2H_6$), or propane ($C_3H_8$) or butane ($C_4H_{10}$) at a linear velocity of not less than about 40 centimeters per minute when measured at a temperature of 200° F. (93° C.) wherein the composition of the gaseous atmosphere and temperature and linear velocity of the hydrocarbon gas introduced into the calciner are so related that the reactivity of the calcined coke agglomerates is not more than 8.0%. The maximum temperature of the above mentioned gases or gas mixtures before entering the calciner may be as high as 700° F. (371° C.).

Figure 2:
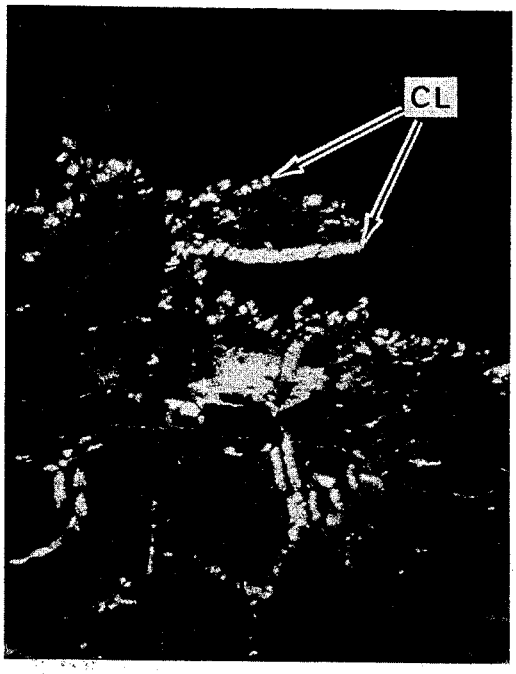
FIG. 2 is a reproduction of a photomicrograph of a typical calcined coke agglomerate which has been calcined at 1700° F. (927° C.) in a gaseous atmosphere which contained 100% propane before cracking. The photomicrograph was taken at a magnification of 735 diameters.
Figure 3:
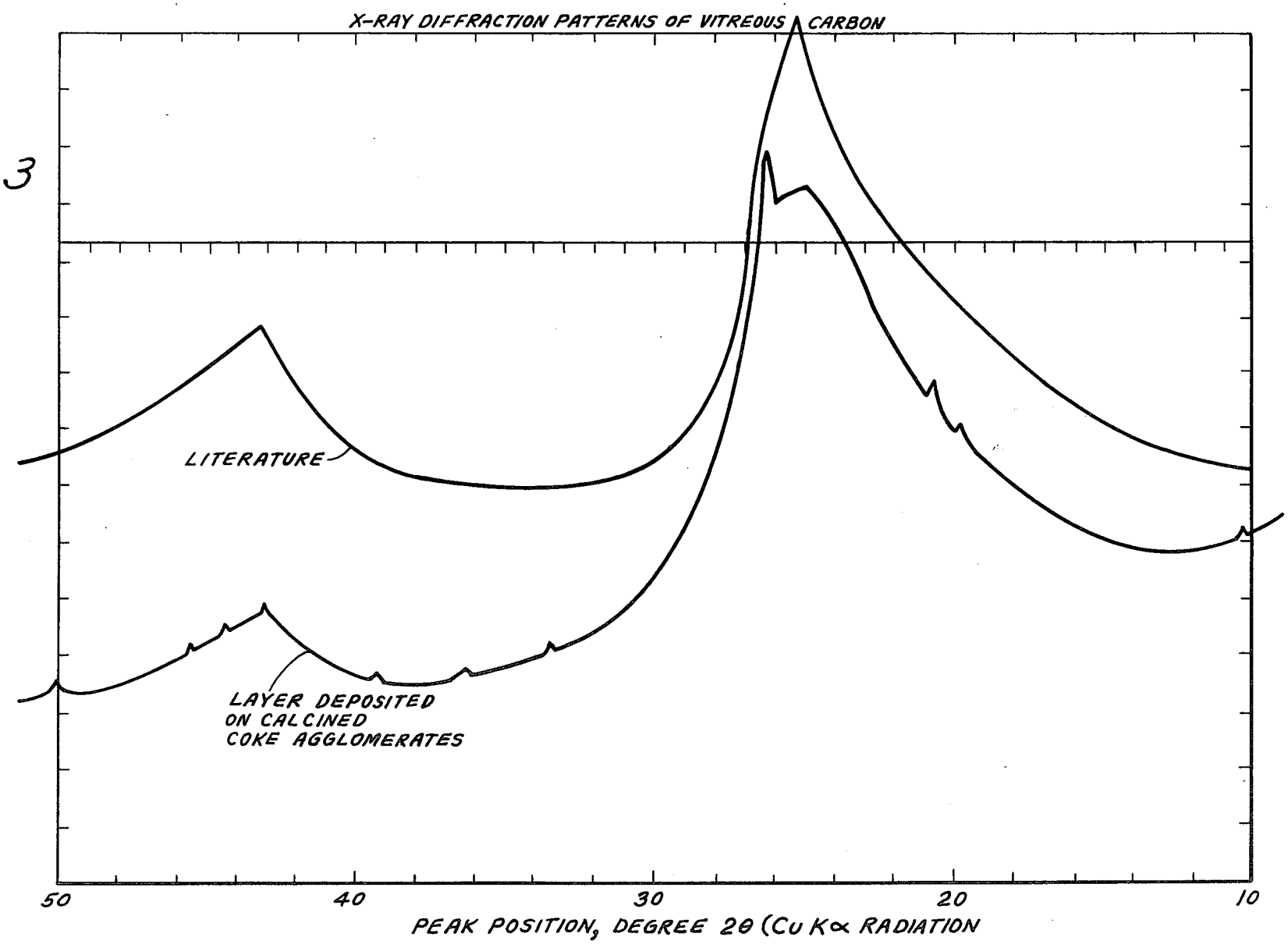
FIG. 3 is a graph comparing the X-ray diffraction pattern of the layer of vitreous carbon deposited on the surface, in the fissures and in the pores of a calcined coke agglomerate which had been calcined at 1700° F. (927° C.) in a gaseous atmosphere which before cracking contained 100% propane ($C_3H_8$) gas and the X-ray diffraction pattern of vitreous carbon as tested and shown in literature.

Petrographic examination of the calcined coke agglomerates shows that a thin layer of graphite-like carbon is deposited on the surface, in the fissures and in the pores of the calcined coke agglomerates during calcining. A typical example of a calcined coke agglomerate which had been calcined at 1700° F. (927° C.) in an atmosphere which contained 100% by volume propane ($C_3H_8$) gas when introduced into the calciner is shown in FIG. 2. It can be seen that a crenulated carbon layer (CL) is deposited on the surface, in the fissures and pores of the calcined coke agglomerate. A pattern developed by X-ray diffraction studies of the thin dense carbon layer identified the carbon as vitreous carbon. The pattern was similar to the pattern developed by X-ray diffraction studies of vitreous carbon as shown in "Catalytic Oxidation of Carbon" by E. T. Turkdogan and J. V. Vinters, Carbon, Vol. 10, pages 97–111, 1972, in FIG. 3. Note that the curve representing coke agglomerates calcined at 1700° F. (927° C.) in the presence of a gaseous atmosphere which was 100% propane very nearly coincides with the curve representing vitreous carbon. The reactivity of these calcined coke agglomerates was 0.9%, which is lower than the 2% to 8% of coke oven coke. The curve representing coke agglomerates calcined at 1700° F. (927° C.) in a 100% atmosphere of nitrogen shows a curve similar to the vitreous carbon curve, however at a reduced level. Apparently, there was some development of vitreous carbon. It is postulated that the presence of a small amount of vitreous carbon may be due to the cracking of a small portion of volatile matter remaining in the green coal agglomerates after agglomerating. It has been found that calcined coke agglomerates do have some volatile matter, about 2% to 4% of the original volatile matter, remaining when discharged from the calciner. However, the apparent vitreous carbon on the coke agglomerates calcined at 1700° F. (927° C.) in 100% nitrogen atmosphere had little if any effect on the reactivity of the calcined coke agglomerates since they showed a very high reactivity of 15.5% indicating that very little vitreous carbon was formed on the surface of the calcined coke agglomerates. Green coal agglomerates calcined at 2350° F. (1288° C.) in an atmosphere which was 100% propane prior to calcining had very little if any vitreous carbon formed on their surfaces. These calcined agglomerates had a very low reactivity of 0.4%. The low reactivity is expected since high calcining temperatures are known to decrease the reactivity of coke to a minimum. The process of the invention, however, provides desirably low reactivities without the use of very high, and expensive, calcining temperatures.

In the examples shown above, the velocity of the gases introduced into the calciner varied between 40 to 60 centimeters per minute measured at 200° F. (93° C.). When the velocity is reduced to below 40 centimeters per minute, the layer of vitreous carbon on the surface of the calcined coke agglomerates is found to be discontinuous. As a result, areas of the calcined coke agglomerates are not protected from the environment in which they will be used, that is, in an atmosphere containing carbon dioxide. The unprotected areas can be contacted by the gaseous carbon dioxide, thus the reactivity of the calcined coke agglomerates is relatively high. Any velocity greater than 60 centimeters per minute can be used, however, increased thicknesses of the layer of vitreous carbon do not reduce the reactivity of the calcined coke agglomerates to gaseous carbon dioxide. Thus, higher velocities are wasteful of the hydrocarbon gases.

It is postulated that the layer of relatively unreactive vitreous carbon deposited on the surface and in the fissures and in the pores of the calcined coke agglomerates protects them from direct contact with carbon dioxide and appreciably reduces the reaction between carbon in the calcined coke agglomerates and gaseous carbon dioxide. Apparently, the layer of vitreous carbon is only slightly reactive with carbon dioxide and provides a barrier to the carbon dioxide, thereby prolonging the life of the calcined coke agglomerates. The above explanation is theory and we do not wish to be held to such theory.

Figure 4:
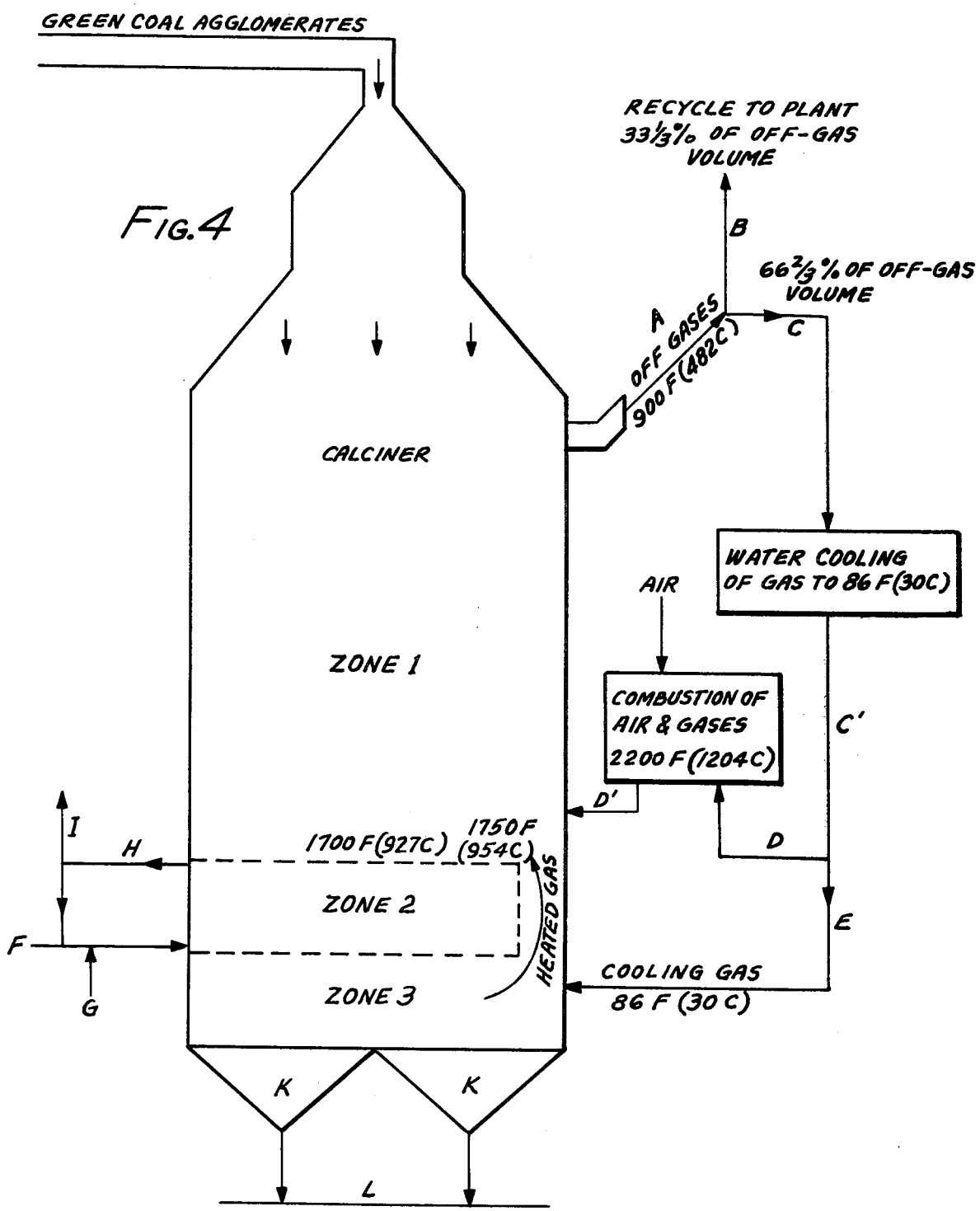
FIG. 4 is a block diagram of the process of the invention as applied to a vertical calciner.

The process of the invention can be used to calcine green coal agglomerates to produce calcined coke agglomerates having a reactivity of 2% to 8% in a modified vertical commercial type calciner as shown schematically in FIG. 4. Green coal agglomerates at a temperature within the range of 700° F. to 850° F. (371° C. to 454° C.) are charged into the top of the calciner and passed downwardly through the calciner. Heated gases at a temperature not less than 1750° F. (954° C.) pass upwardly through the bed of green coal agglomerates. The green coal agglomerates are heated to a temperature of at least 1700° F. (297° C.) by heat exchange with the heated gases. The heating gases are cooled to a temperature of about 900° F. (482° C.) and pass out of the calciner near its top portion. The volume of off-gases A is divided into portion B and portion C. Portion B, which is about 33⅓% by volume of off-gases A, is recycled to the plant where it can be reused, for example, to heat the materials to be agglomerated in an agglomerating drum. Portion C is cooled to a temperature of about 86° F. (30° C.). Cooled portion C′ is further divided into portion D and portion E. Portion D which is about 45% of the volume of cooled portion C′ is mixed with a sufficient volume of air in a combustion chamber and is burned to heat it to a temperature of about 2200° F. (1204° C.). The heated gases D′ are introduced into the calciner through refractory duct inserts (not shown) spaced uniformly in the bottom of Zone 1 of the calcining zone. Portion E at a temperature of about 86° F. (30° C.) is introduced into Zone 3 or precooling zone of the calciner by other refractory duct inserts in the bottom portion of the calciner.

Interspersed between Zone 1 and Zone 3 is Zone 2 or gase treatment zone of the calciner. In Zone 2, a gaseous atmosphere is cracked to produce carbon and hydrogen. The carbon is deposited as vitreous carbon on the surfaces, in the fissures and in the pores of the calcined coke agglomerates. The gaseous atmosphere introduced into Zone 2 contains at least 20% of at least one straight chain aliphatic hydrocarbon gas taken from the group consisting of methane, ethane, propane and butane, the remainder being hydrogen.

On the basis of coating one pound of calcined coke agglomerates, it is required to use 1.6 cubic feet of a gaseous atmosphere F, containing 20% propane and 80% hydrogen. The gaseous atmosphere is introduced into Zone 2 of the calciner through refractory duct inserts. The gaseous atmosphere F is heated to a temperature within the range of 200° F. to 700° F. (93° C. to 371° C.). The propane is cracked at the temperature of 1700° F. (927° C.) in Zone 2 producing carbon and hydrogen. The carbon is deposited as vitreous carbon on the surface, in the fissures and in the pores of the calcined coke agglomerates. The hydrogen is removed from Zone 2 by other refractory duct inserts. Since hydrogen is produced by cracking in Zone 2, a portion of the hydrogen containing gas in H amounting to 1.27 cubic feet I is bled from the system. It is necessary to replenish the propane in gase F to maintain the ratio of 20% propane—80% hydrogen in F, therefore, for each pound of calcined coke agglomerates to be treated, 0.32 cubic feet of propane G is introduced into gas F.

If it is desired to use a gaseous atmosphere comprising 20% methane and 80% hydrogen to treat the calcined coke agglomerates, it is necessary to introduce 2.25 cubic feet of the gas for every pound of calcined coke agglomerates to be treated. The gas is heated to 700° F. (371° C.) prior to being introduced into the calciner. About 2.7 cubic feet of hydrogen gas H at a temperature of about 1600° F. (871° C.) is removed from Zone 2. To maintain the desired material balance in the treatment zone about 0.9 cubic feet of hydrogen I is removed from the gas H and 0.45 cubic feet of methane G is added to the gas F which is recycled into the calciner.

During the treatment of the calcined coke agglomerates in Zone 2, the calcined coke agglomerates are cooled to about 1500° F. (816° C.). The calcined coke agglomerates pass to Zone 3 where they are precooled by heat exchange with gas E which is introduced into the calciner through other refractory inserts to a temperature of about 800° F. (427° C.). The gas E is heated by heat exchange with the calcined coke agglomerates and passes upwardly to be mixed with the heated gases D′ lowering the temperature of the gases D′ to between 1700° F. and 1950° F. (927° C. to 1066° C.). The calcined coke agglomerates cooled to about 800° F. (427° C.) are passed to a cooler K wherein the temperature is further reduced to about 300° F. (149° C.). The cooled coated calcined coke agglomerates are discharged from the calciner to an appropriate transport mechanism such as a conveyor L.

I claim:

1. An improved process for producing calcined coke agglomerates from green coal agglomerates, wherein said green coal agglomerates are calcined in a calciner at a temperature within the range of 1700° F. to 1950° F. (927° C. to 1066° C.), said calcined coke agglomerates characterized by having a reactivity to carbon dioxide of 2% to 8%, said process comprising introducing a gaseous atmosphere containing at least 20% by volume of at least one straight chain aliphatic hydrocarbon gas taken from the group consisting of methane, ethane, propane and butane and admixtures thereof into a bed of calcined coke agglomerates in said calciner whereby said hydrocarbon gas is cracked producing carbon and hydrogen, said carbon being relatively unreactive vitreous carbon which is deposited on the surface, in the fissures and in the pores of said calcined coke agglomerated to thereby limit the reactivity of said calcined coke agglomerates to carbon dioxide to a range which is between 2% and 8%.

2. The process as claimed in claim 1 wherein said hydrocarbon gas is introduced into said calciner during calcining of said green coal agglomerates.

3. The process as claimed in claim 1 wherein said hydrocarbon gas is introduced into said calciner immediately after said green coal agglomerates have been calcined to form calcined coke agglomerates, said calcined coke agglomerates being at a temperature within the range of 1700° F. to 1950° F. (927° C. to 1066° C.).

4. The process as claimed in claim 1 in which the hydrocarbon gas introduced into the calciner is ethane.

5. The process as claimed in claim 1 in which the hydrocarbon gas introduced into the calciner is propane.

6. The process as claimed in claim 1 in which the hydrocarbon gas introduced into the calciner is butane.

7. The process as claimed in claim 1 in which the hydrocarbon gas introduced into the calciner is methane.

8. The process as claimed in claim 1 in which the hydrocarbon gas introduced into the calciner is a combination of at least two gases taken from the group consisting of methane, ethane, propane and butane.

* * * * *